US010507160B1

(12) United States Patent
Losole

(10) Patent No.: US 10,507,160 B1
(45) Date of Patent: Dec. 17, 2019

(54) MASSAGE BAG WITH CONFIGURABLE POSITIONS

(71) Applicant: Circus Shark Productions, Inc., Omaha, NE (US)

(72) Inventor: David Losole, Omaha, NE (US)

(73) Assignee: Circus Shark Productions, Inc., Omaha, NE (US)

( * ) Notice: Subject to any disclaimer, the term of this patent is extended or adjusted under 35 U.S.C. 154(b) by 828 days.

(21) Appl. No.: 14/991,760

(22) Filed: Jan. 8, 2016

(51) Int. Cl.
*A61H 15/00* (2006.01)
*B65B 5/02* (2006.01)
*A61H 39/04* (2006.01)

(52) U.S. Cl.
CPC ..... *A61H 15/0092* (2013.01); *B65B 5/022* (2013.01); *A61H 39/04* (2013.01); *A61H 2015/0042* (2013.01); *A61H 2015/0064* (2013.01)

(58) Field of Classification Search
CPC ..... A61H 15/0092; A61H 2015/0064; A61H 15/00; A61H 39/04; A61H 2201/1284; A61H 2015/0042; B65B 5/022
See application file for complete search history.

(56) References Cited

U.S. PATENT DOCUMENTS 5,628,772 A * 5/1997 Russell ..... A61F 7/10 601/112
6,174,297 B1 * 1/2001 Chen ..... A47K 7/02 15/209.1
2003/0144616 A1 * 7/2003 Henderson ..... A61H 15/00 601/131
2008/0287842 A1 * 11/2008 Benson-Gorelick ..... A61H 15/00 601/134
2010/0087762 A1 * 4/2010 Herbert ..... A61H 7/001 601/134

* cited by examiner

*Primary Examiner* — Quang D Thanh
(74) *Attorney, Agent, or Firm* — Suiter Swantz pc llo

(57) ABSTRACT

A massage apparatus includes a sealed bag including a single compartment containing one or more massage spheres, and one or more configuration strips. A configuration strip includes a piece of textile attached to an exterior side of the bag at one or more attachment points. A method for making a massage apparatus includes obtaining a piece of fabric, folding the fabric along a fold line, sewing a first seam along a first side adjacent to the fold line, sewing a second seam along a second side adjacent to the fold line, sewing a third seam along a third side opposite the fold line, reversing the bag through the gap such that the seams are located on the interior of the bag, inserting one or more massage spheres into the bag, sewing a fourth seam along the gap, and attaching one or more configuration strips to the exterior of the bag.

10 Claims, 6 Drawing Sheets

MASSAGE BAG WITH CONFIGURABLE POSITIONS

TECHNICAL FIELD

The present disclosure relates generally to the field of massage devices, and in particular, to the field of configurable massage devices.

BACKGROUND

Massage devices are typically designed with a fixed size and shape, which limits the effectiveness at treating a wide range of areas. It is therefore desirable to provide a configurable massager that cures this defect.

SUMMARY

A massage apparatus is disclosed in accordance with one illustrative embodiment of the present disclosure. In one illustrative embodiment, the massage apparatus includes a sealed bag including a single compartment. In another illustrative embodiment, the bag comprises one or more pieces of fabric sealed with one or more seams. In another illustrative embodiment, the massage apparatus includes one or more massage spheres contained inside the compartment. In another illustrative embodiment, the massage apparatus includes one or more configuration strips. In another illustrative embodiment, a configuration strip comprises a piece of textile attached to an exterior side of the bag at one or more attachment points separated by one or more gaps.

A method for making a massage apparatus is disclosed in accordance with one or more illustrative embodiments of the present disclosure. In one illustrative embodiment, the method includes obtaining a rectangular piece of fabric. In another illustrative embodiment, the method includes folding the rectangular piece of fabric along a fold line to generate a bag with four sides. In another illustrative embodiment, the fold line is a line of symmetry of the rectangular piece of fabric. In another illustrative embodiment, the method includes sewing a first seam along a first side adjacent to the fold line to fully seal the first side. In another illustrative embodiment, the method includes sewing a second seam along a second side adjacent to the fold line to fully seal the second side. In another illustrative embodiment, the method includes sewing a third seam along a third side opposite the fold line. In another illustrative embodiment, the third seam has a gap centered along a length of a third side. In another illustrative embodiment, the method includes reversing the bag through the gap such that the seams are located on the interior of the bag. In another illustrative embodiment, the method includes attaching one or more configuration strips to the exterior of the bag at one or more attachment points separated by one or more gaps. In another illustrative embodiment, a configuration strip comprises a piece of textile. In another illustrative embodiment, the method includes inserting one or more massage spheres into the bag. In another illustrative embodiment, the method includes sewing a fourth seam along the gap to fully seal the bag.

BRIEF DESCRIPTION OF DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings. The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

Referring generally to FIGS. 1-5, a massage apparatus and a method for making a massage apparatus are disclosed in accordance with one or more embodiments of the present disclosure. Embodiments of the present disclosure are directed to a massage bag 100 with one or more massage spheres 130 located within an interior compartment of the massage bag 100. Additional embodiments of the present disclosure are directed to a massage bag 100 with one or more configuration straps 110 suitable for controlling the arrangement of the one or more massage spheres 130 in the massage bag 100.

Figure 1:
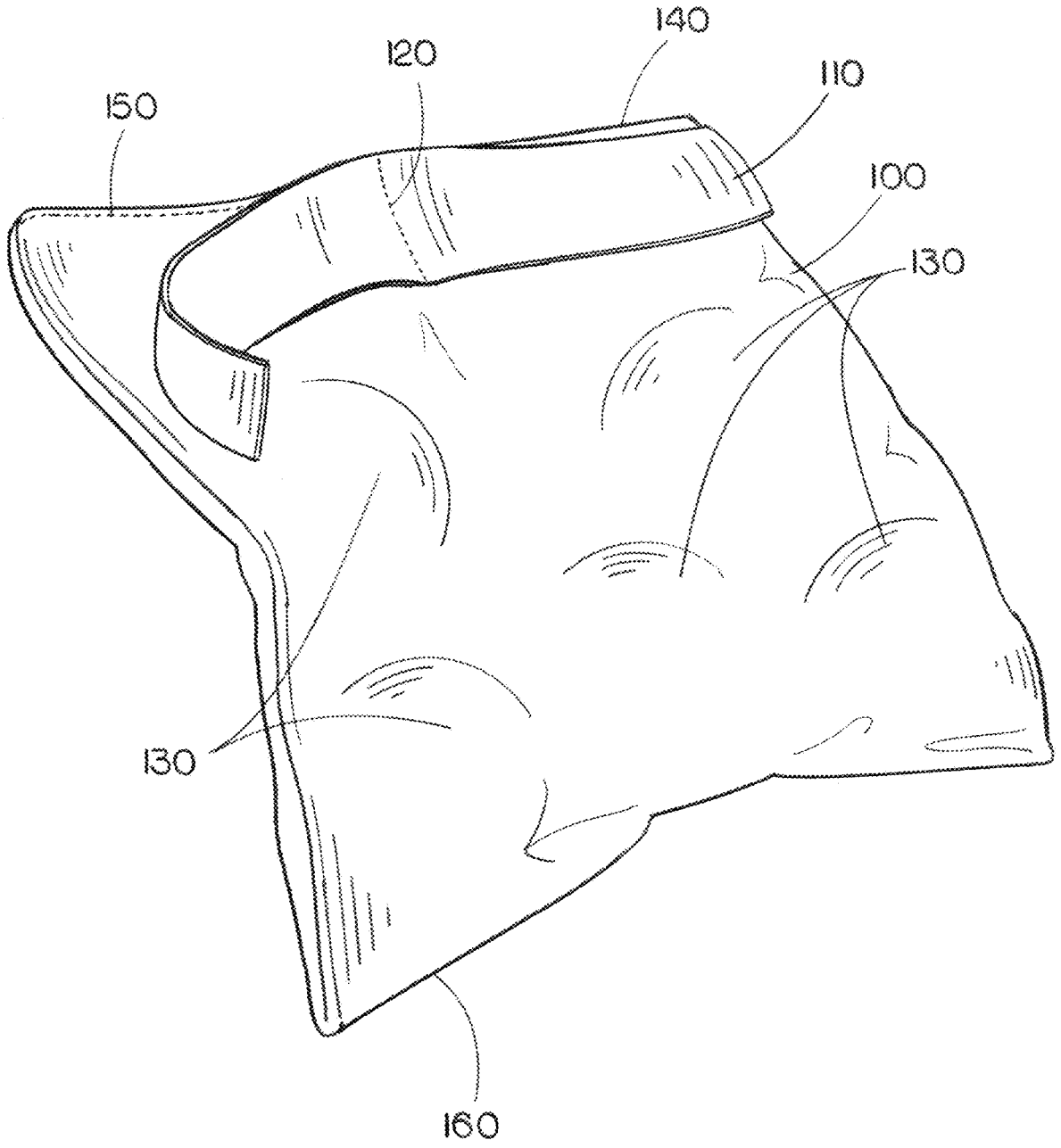
FIG. 1 is a schematic diagram illustrating a massage apparatus with a configuration strip, in accordance with one or more embodiments of the present disclosure.

FIG. 1 is a schematic of a massage bag 100 in accordance with one or more embodiments of the present disclosure. In one embodiment, one or more massage spheres are located within an interior compartment of the massage bag 100. In another embodiment, one or more configuration strips 110 are attached at one or more attachment points 120 to the exterior of the massage bag 100. For example, as shown in FIG. 1, a single configuration strip 110 with a length approximately equal to the length of a side 140 of the massage bag may be attached at a single attachment point 120 at a position central to both the configuration strip 110 and the side 140 of the massage bag 100. In this way, portions of the configuration strip 110 are not attached to the massage bag 100. As another example, multiple configuration strips 110 may be attached to the exterior of the massage bag 100.

At least one of the one or more configuration strips 110 may form a loop. In one embodiment, one of the one or more configuration strips 110 is formed from a single piece of rectangular fabric in which two ends of the fabric are overlapped and attached to the exterior of the massage bag 100 at a single attachment point 120. In another embodiment, one of the one or more configuration strips 110 are attached to the exterior of the massage bag 100 at two attachment points 120 separated by a gap such that a loop is formed in the gap between the configuration strip 110 and the exterior of the massage bag 100.

In one embodiment, the massage bag 100 is formed from a single piece of rectangular fabric folded along a symmetry line such that two opposite ends of the piece of rectangular fabric are overlapped to form a rectangular bag. In this way, one side of the massage bag 100 is formed from a fold line 160 along the symmetry line, and the remaining sides of the massage bag 100 are formed from seams. In one embodiment, the massage bag 100 is sealed with interior seams along the two sides adjacent to the fold line 160. In another embodiment, the side opposite the fold line 160 is partially sealed with an interior seam and partially sealed with an external seam 150. It is noted herein that the massage bag 100 may contain one or more interior seams for the purpose of enhancing durability. In one embodiment, the interior seams are double-stitched to further enhance durability of the massage bag 100.

The massage bag 100 and the configuration strips 110 may be constructed from any suitable material. In one embodiment, the massage bag 100 is constructed from a stretchable fabric capable of stretching to an extended length up to 1.5 times a length in a relaxed state. In one embodiment, the one or more configurations strips 110 are constructed from string. In another embodiment, the one or more configuration strips 110 are constructed from fabric. In another embodiment, the one or more configuration strips 110 are constructed from a stretchable fabric capable of stretching to an extended length up to 1.5 times a length in a relaxed state.

The one or more massage spheres 130 may be of any size suitable for massaging. In one embodiment, the one or more massage spheres 130 have a diameter in the range of 41 to 43 mm. Massage spheres 130 of this size may be configured for massaging all muscle groups including, but not limited to hands, feet, upper and lower portions of the back, or shoulders. It is noted herein that the size of the one or more massage spheres 130 may be adjusted to target specific muscle groups. For example, the size of the one or more massage spheres 130 targeting larger muscle groups such as quadriceps or the chest may be, but is not limited to be, different than one or more massage spheres 130 targeting smaller areas such as hands or feet.

The massage bag 100 may be of any size and contain any number of massage spheres 130 suitable for massage one or more muscle groups. In one embodiment, a massage bag 100 has a square shape with sides approximately 15 cm in length and contains five massage spheres 130. A massage bag of this size and shape may be configured for, but is not limited to, use as a foot massager. In another embodiment, a massage bag 100 has a square shape with sides approximately 11 cm in length and contains three massage spheres 130. A massage bag of this size and shape may be configured for, but is not limited to, use as a hand massager. In a further embodiment, a massage bag has a hemispherical shape with a radius of approximately 12 cm and contains eight massage spheres 130. A massage bag 100 of this size and shape may be configured for, but is not limited to, massaging larger muscle groups by placing the massage bag on a surface and rubbing the intended muscle groups on the massage bag. It is noted herein that the provided examples should be interpreted as illustrative rather than limiting and that a multiplicity of additional configurations of the size of the massage bag 100, the shape of the massage bag 100, and the number of massage spheres 130 located within an interior compartment of the massage bag 100 are within the scope and spirit of the present disclosure. For example, a massage bag 100 may contain greater than 17 massage spheres 130 and be configured to target large muscle groups such as the chest or back.

It is noted herein that the one or more massage spheres 130 may move freely within the interior of the massage bag and that the one or more massage spheres 130 are not attached to the massage bag 100. In this way, the positions of the one or more massage spheres 130 may be freely configured. In another embodiment, the one or more massage spheres 130 are loosely packed within the interior of the massage bag 100 such that the one or more spheres 130 do not touch when arranged in a maximally spaced orientation. In another embodiment, the one or more massage spheres 130 are tightly packed within the interior of the massage bag 100 such that at least two spheres 130 are in contact. It is noted herein that a tightly packed configuration of one or more massage spheres 130 inhibits the movement of massage spheres 130 relative to each other within the interior of the bag, but does not inhibit the rotational motion of the massage spheres 130.

Figure 2A:
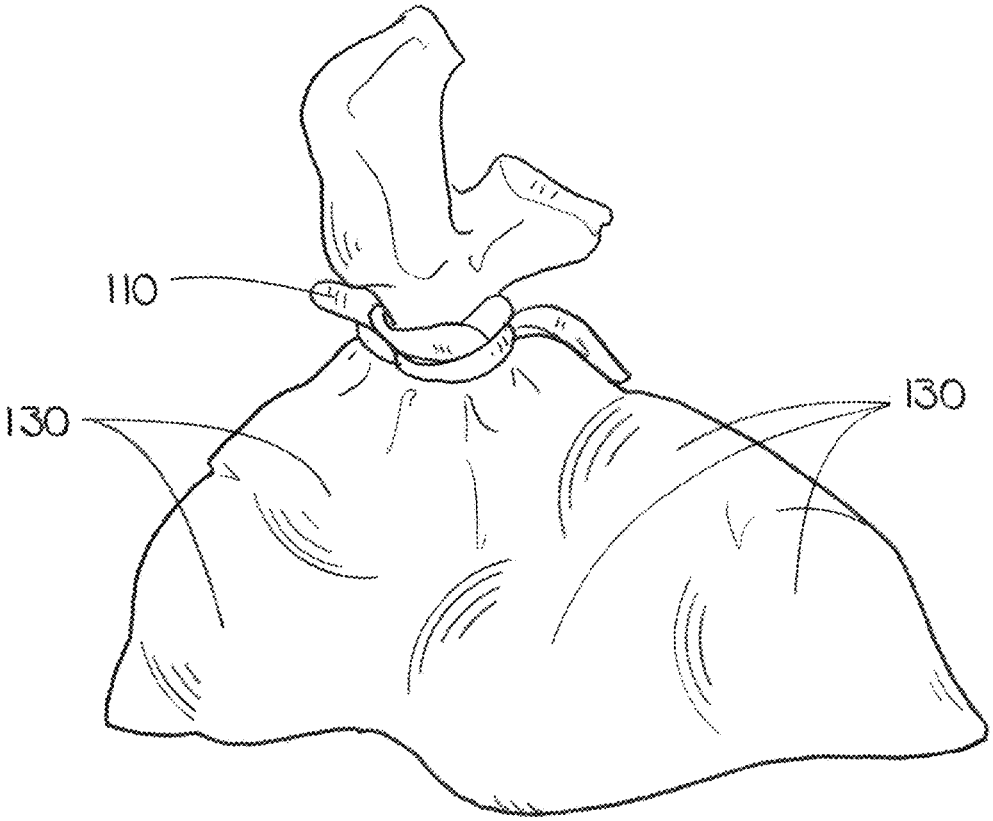
FIG. 2A is a schematic diagram illustrating a massage apparatus in which a configuration strip is configured to secure five massage spheres within a single cavity within the interior of the massage apparatus, in accordance with one or more embodiments of the present disclosure.
Figure 2B:
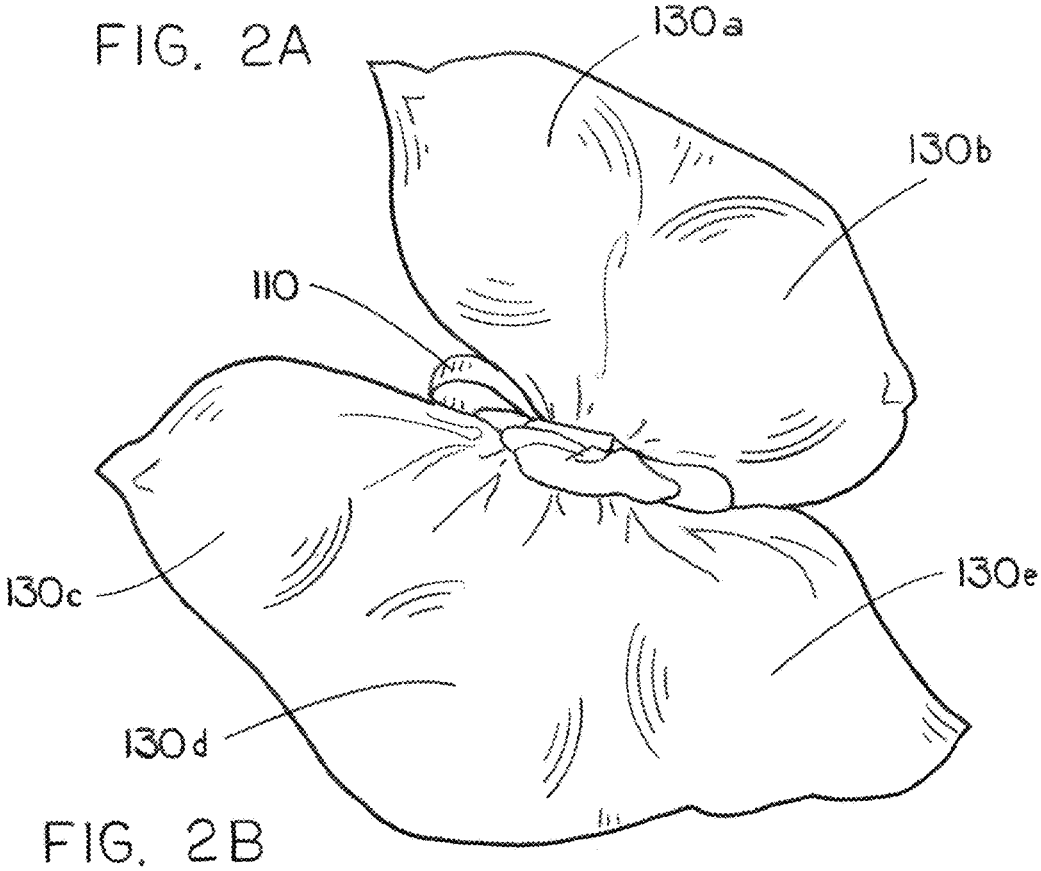
FIG. 2B is a schematic diagram illustrating a massage apparatus in which a configuration strip is configured to secure two massage spheres within a first cavity and three massage spheres within a second cavity within the interior of the massage apparatus, in accordance with one or more embodiments of the present disclosure

It is noted herein that the one or more configuration strips may be used to freely configure the positions of the one or more massage spheres 130 within the massage bag 100. For example, a single configuration strip 110 attached at a single attachment point located central to the length of the configuration strip (e.g. as shown in FIG. 1) may include two loose ends; these two loose ends may be wrapped around the massage bag 100 in a multitude of configurations and tied together to securely control the positions of the one or more massage spheres 130. As another example, two configuration strips 110 attached to the exterior of the massage bag 100 may be similarly wrapped around the massage bag 100 in a multitude of configurations and tied together to securely control the positions of the one or more massage spheres 130. FIGS. 2A and 2B are schematic diagrams illustrating two configurations of a massage bag 100 including five massage spheres 130, in accordance with two or more embodiments of the present disclosure. FIG. 2A illustrates one embodiment in which in which all five massage spheres 130 are tightly constrained in a single cavity within the interior of the massage bag 100 by one or more configuration strips 110. FIG. 2B illustrates another embodiment in which one or more configuration strips 110 constrain two massage spheres 130*a* and 130*b* into a first cavity within the interior of the massage bag 100 and further constrain three massage spheres 130*c*, 130*d*, and 130*e* into a second cavity within the interior of the massage bag 100.

Figure 3:
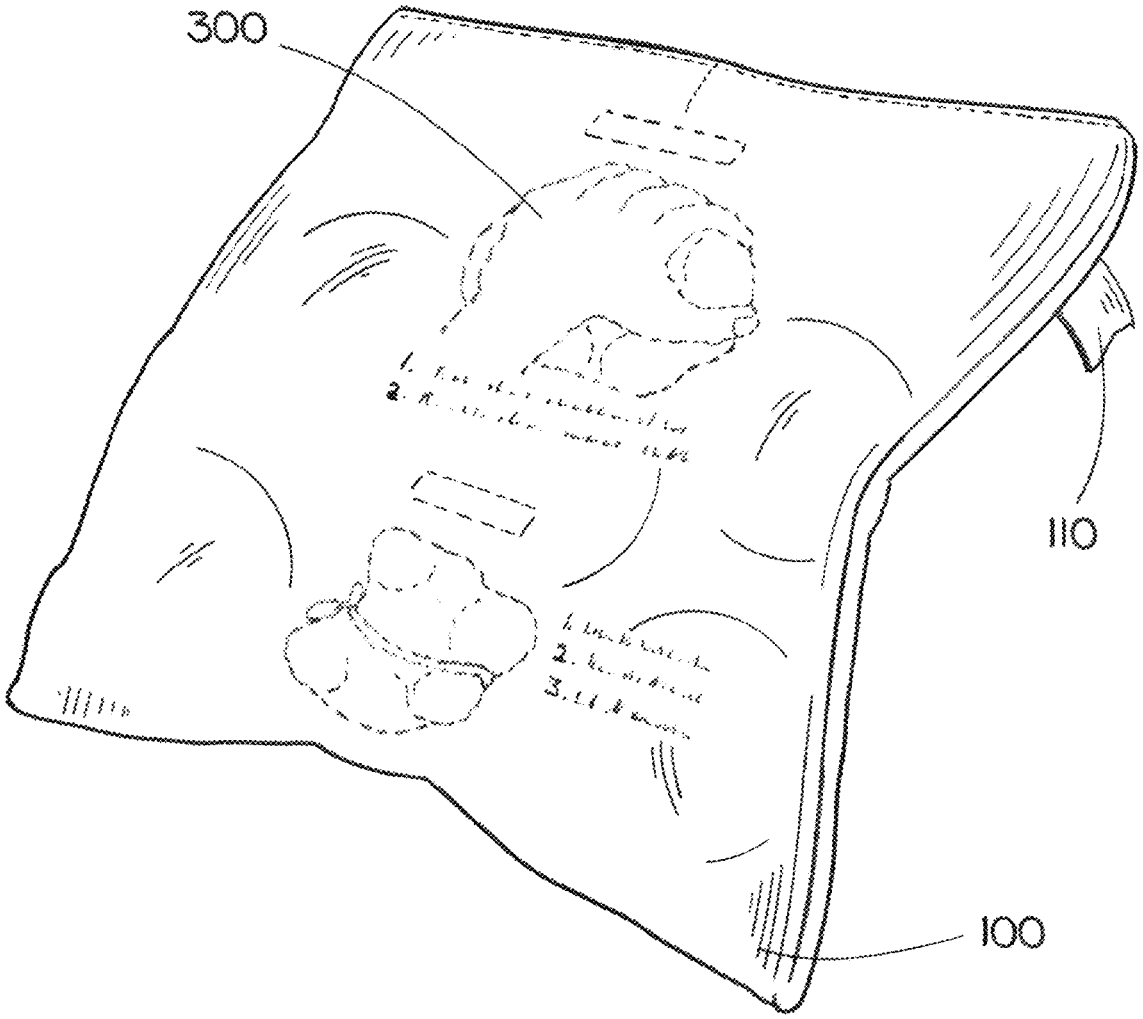
FIG. 3 is a schematic diagram illustrating a massage apparatus with written and graphical content on the exterior of the apparatus, in accordance with one or more embodiments of the present disclosure.

One or both sides of the exterior of the massage bag 100 may include graphical or written content. In one embodiment, a company logo and contact information may be printed on one side of the massage bag 100. In another embodiment, a foot reflexology chart is printed on one side of the massage bag 100. As shown in FIG. 3, in one embodiment, written and graphical instructions 300 are printed on one side of the massage bag 100. It is noted herein that graphical or written content may be applied to the exterior of the massage bag 100 according to any method known in the art. For example, graphical or written content may be applied to the exterior of the massage bag 100 by a dye sublimation process.

Figure 4:
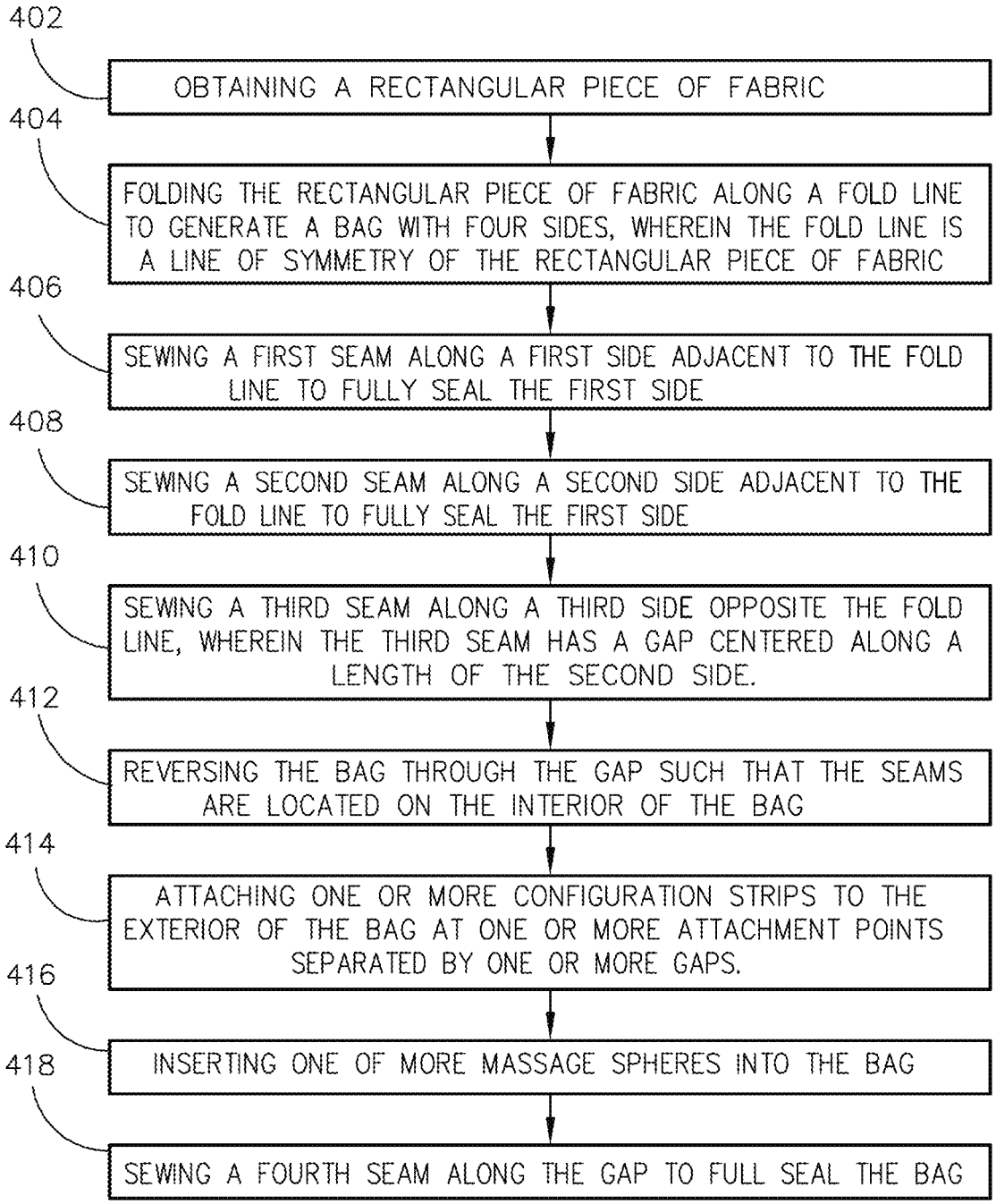
FIG. 4 is a flow diagram illustrating a method for making a massage apparatus, in accordance with one or more embodiments of the present disclosure.
Figure 5A:
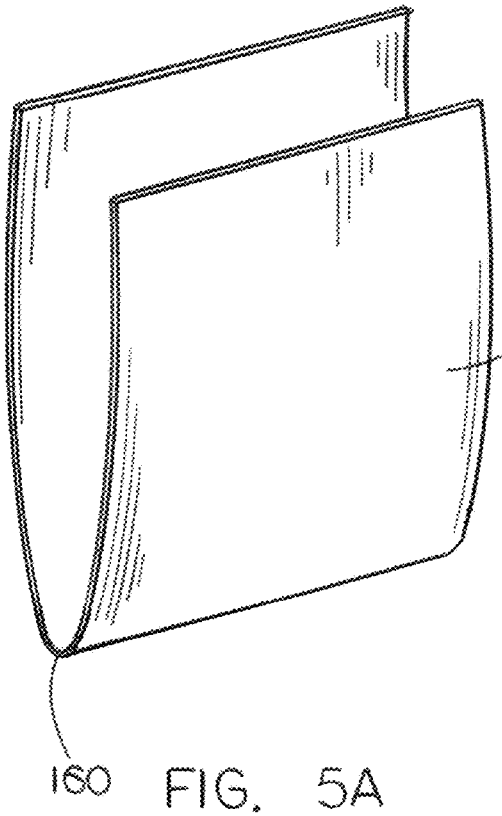
FIG. 5A is a schematic diagram illustrating a single piece of fabric folded along a fold line, in accordance with one or more embodiments of the present disclosure.
Figure 5B:
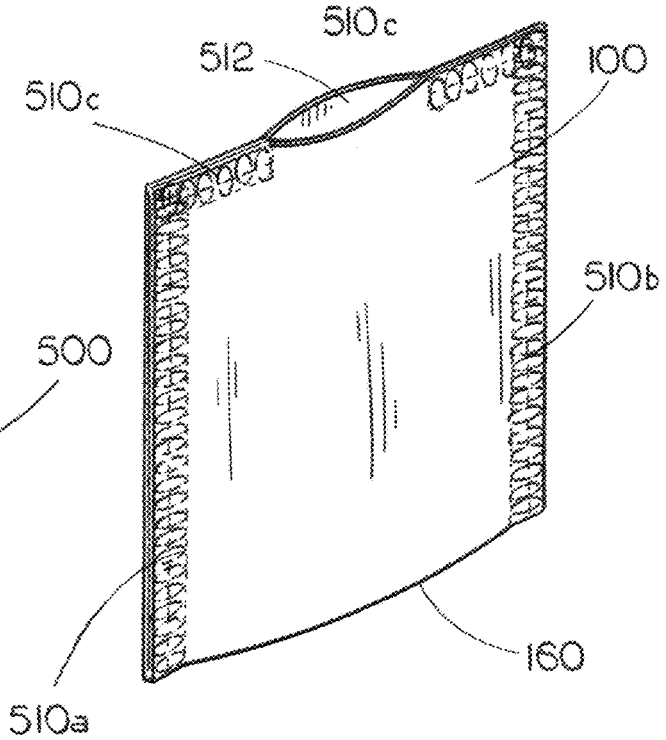
FIGS. 5B and 5C are schematic diagrams illustrating seams along sides of a bag including a gap in a seam, in accordance with one or more embodiments of the present disclosure.
Figure 5C:
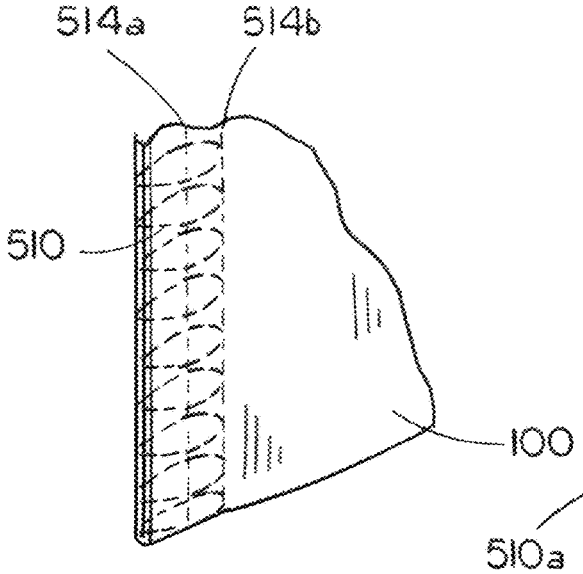
Figure 5D:
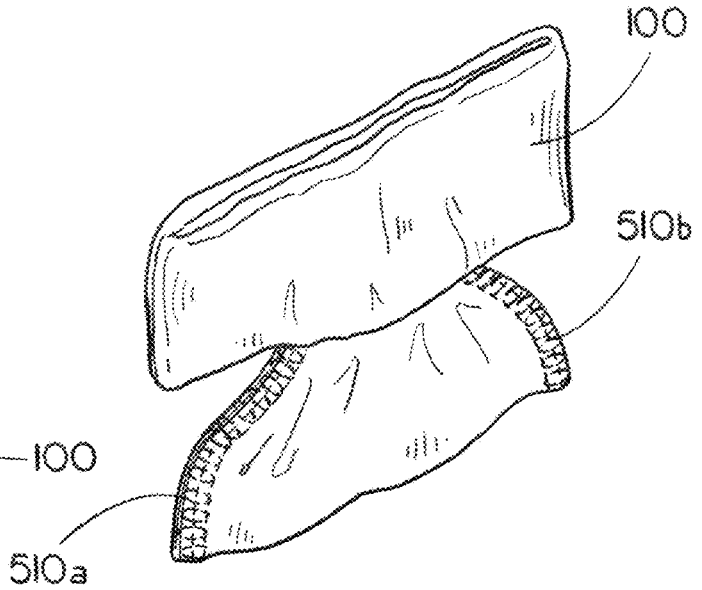
FIG. 5D is a schematic diagram illustrating reversing a bag through a gap in a seam, in accordance with one or more embodiments of the present disclosure.
Figure 5E:
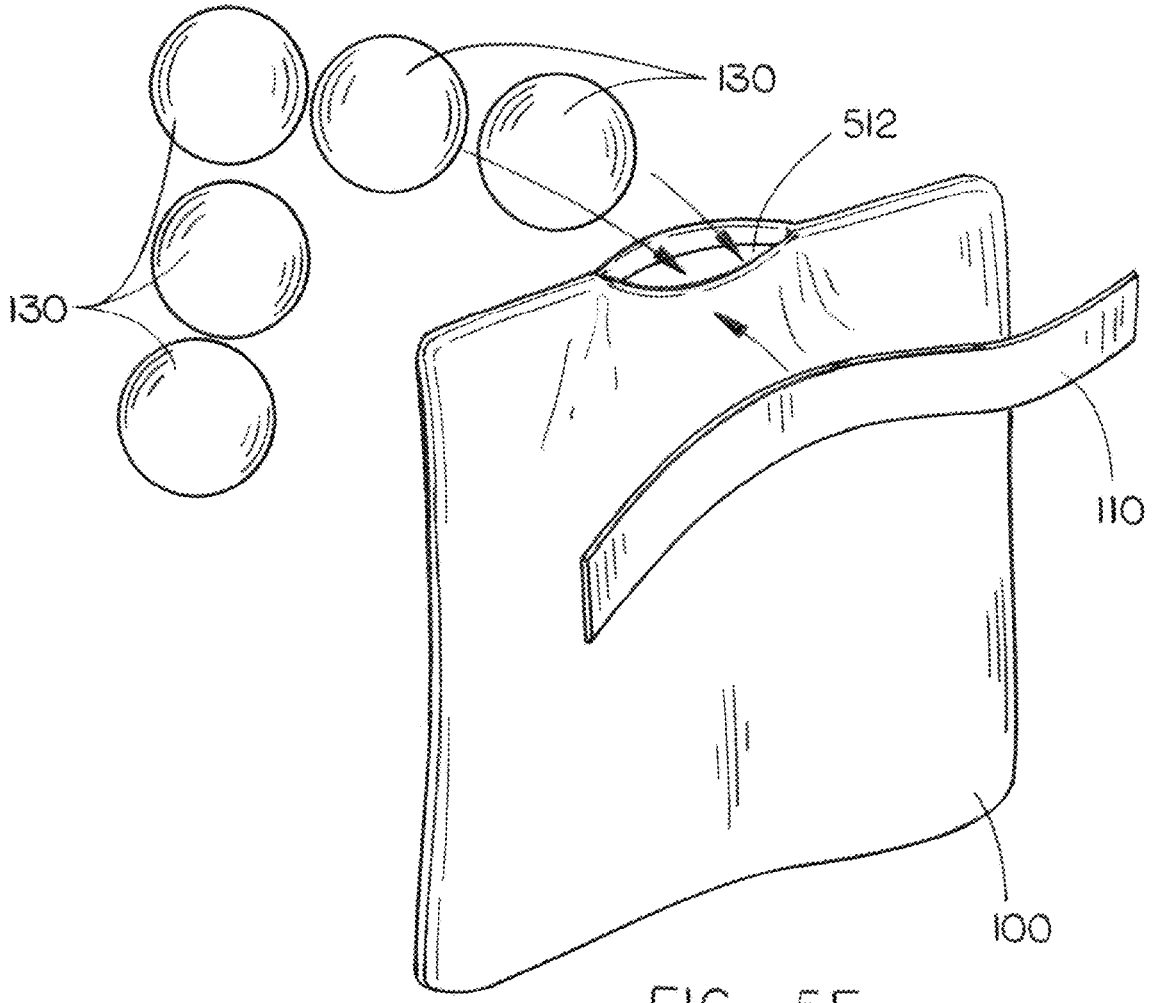
FIG. 5E is a schematic diagram illustrating inserting of massage spheres through the gap of a bag, in accordance with one or more embodiments of the present disclosure.
Figure 5F:
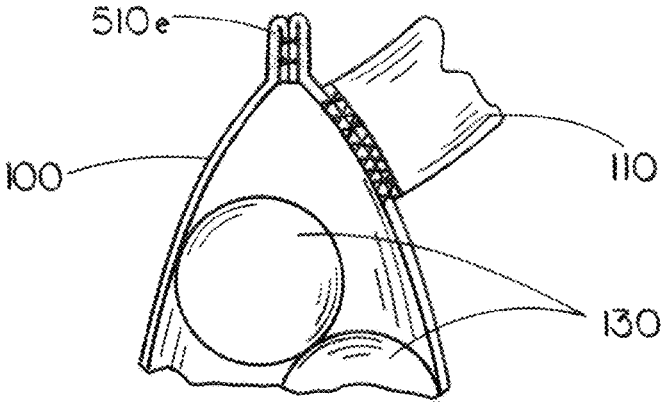
FIG. 5F is a schematic diagram illustrating a seam sealing a bag containing massage spheres and a seam attaching a configuration strip to a bag, in accordance with one or more embodiments of the present disclosure.

FIGS. 4-5 include a flow chart and schematic diagrams illustrating a method for constructing a massage bag 100, in accordance with one or more embodiments of the present disclosure. In step 402, a rectangular piece of fabric 500 is obtained. In step 404, the rectangular piece of fabric 500 is folded along a fold line 502 to generate a bag 100 with four sides, wherein the fold line 502 is a line of symmetry of the rectangular piece of fabric 500. In step 406, a first seam 510*a* is sewn along a first side adjacent to the fold line 502. In step 408, a second seam 510*b* is sewn along a second side adjacent to the fold line 502. In a third step 410, a third seam 510*c* is sewn along a third side opposite the fold line 502, wherein the third seam 510*c* has a hap 512 centered along a length of the third side, and wherein a length of the gap 512 is in the range of 50-100 mm. It is noted herein that seams 510*a*, 510*b*, and/or 510*c* may be double-stitched as indicated by stitching lines 514*a* and 514*b* illustrated in FIG. 4C. In step 412, illustrated in FIG. 4D, the massage bag is reversed through the gap such that the seams (e.g. 510*a*, 510*b*, and 510*c*) are located on the interior of the massage bag 100. The massage bag 100 may be reversed by pulling and/or pushing the fabric 500 through the gap 512. In step 414, one or more massage spheres 130 are inserted into the massage bag 100. In step 416, a fourth seam 510*d* is sewn along the gap 512 to fully seal the massage bag 100. In step 418, one or more configuration strips 110 are attached to the exterior of the massage bag 100 at one or more attachment points 120 separated by one or more gaps, wherein a configuration strip 110 comprises a piece of textile.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the disclosure is defined by the appended claims.

What is claimed is:

1. A massage apparatus, comprising:

a sealed bag including a single compartment, wherein the sealed bag comprises one or more pieces of fabric sealed with one or more seams;

one or more massage spheres contained inside the compartment; and a single configuration strip, wherein the single configuration strip comprises a piece of textile, wherein the single configuration strip is oriented along an exterior portion of a first side of the sealed bag, wherein the single configuration strip has a length approximately equal to a length of the first side of the sealed bag, wherein the single configuration strip is attached to the first side of the sealed bag at a single attachment point located central to the length of the first side of the sealed bag.

2. The massage apparatus of claim 1, wherein the one or more pieces of fabric comprising:

a single piece of fabric folded along a fold line to form the sealed bag, wherein the fold line is a line of symmetry of the single piece of fabric, wherein the fold line comprises a first side of the sealed bag.

3. The massage apparatus of claim 2, wherein the one or more seams include one or more interior seams.

4. The massage apparatus of claim 3, wherein a second side includes one or more interior seams and an exterior seam.

5. The massage apparatus of claim 1, wherein the sealed bag comprises:

a rectangular shape.

6. The massage apparatus of claim 1, wherein the one or more pieces of fabric is stretchable up to 1.5 times a length of the one or more pieces of fabric in a relaxed state.

7. The massage apparatus of claim 1, wherein the piece of textile is stretchable up to 1.7 times a length of the textile in a relaxed state.

8. The massage apparatus of claim 1, wherein the single configuration strip comprises:

at least one of fabric or string.

9. The massage apparatus of claim 1, wherein the diameter of the one or more massage spheres is in the range of 41 to 43 mm.

10. The massage apparatus of claim 1, wherein the one or more spheres are loosely packed such that the one or more spheres do not touch in a maximally spaced orientation.

* * * * *